United States Patent [19]

Terauchi

[11] Patent Number: 4,913,626

[45] Date of Patent: Apr. 3, 1990

[54] WOBBLE PLATE TYPE COMPRESSOR WITH VARIABLE DISPLACEMENT MECHANISM

[75] Inventor: Kiyoshi Terauchi, Isesaki, Japan

[73] Assignee: Sanden Corporation, Gunma, Japan

[21] Appl. No.: 222,418

[22] Filed: Jul. 21, 1988

[30] Foreign Application Priority Data

Jul. 24, 1987 [JP] Japan ..... 62-183598

[51] Int. Cl.[4] ..... F04B 1/26

[52] U.S. Cl. ..... 417/222

[58] Field of Search ..... 417/222, 57, 270

[56] References Cited

U.S. PATENT DOCUMENTS

| | | | |
|---|---|---|---|
| 4,428,718 | 1/1984 | Skinner . | |
| 4,580,950 | 4/1986 | Sumikawa | 417/295 |
| 4,664,604 | 5/1987 | Terauchi | 417/270 |
| 4,669,272 | 6/1987 | Kawai | 417/270 |
| 4,723,891 | 2/1988 | Takenaka | 417/222 |
| 4,730,986 | 3/1988 | Kayukawa | 417/222 |
| 4,747,753 | 5/1988 | Taguchi . | |
| 4,842,488 | 6/1989 | Terauchi . | |

FOREIGN PATENT DOCUMENTS

| | | | |
|---|---|---|---|
| 61-55380 | 3/1986 | Japan . | |
| 276279 | 12/1987 | Japan | 417/222 |

*Primary Examiner*—Leonard E. Smith

*Attorney, Agent, or Firm*—Banner, Birch, McKie & Beckett

[57] ABSTRACT

A refrigerant compressor including a compressor housing having a cylinder block is disclosed. A plurality of cylinders are formed around the periphery of the cylinder block and a piston is slidably fitted within each of the cylinders and is reciprocated by a drive mechanism. A crank chamber is formed between the cylinder block and a front end plate of the compressor housing. The drive mechanism includes a drive shaft, a rotor disposed on said drive shaft, a slant plate with an adjustable slant angle disposed adjacent the rotor, and a wobble plate disposed adjacent the slant plate. The drive shaft is rotatably supported within the front end plate. Rotation of the drive shaft causes rotation of the rotor and the slant plate, causing nutational motion of the wobble plate to reciprocate the pistons within their cylinders. The compressor housing includes a rear end plate including suction and discharge chambers. An inlet portion of the suction chamber and an outlet portion of the discharge chamber link the compressor with an external fluid circuit. The inlet portion is linked to an external evaporator. A narrowed portion is located between the inlet portion of the suction chamber and a main portion of the suction chamber and creates a pressure difference therebetween. A communication path links the crank chamber and the suction chamber and is controlled by a valve control means. When the capacity of the compressor is changed, the valve control means links the crank chamber with the external evaporator via the inlet portion due to the pressure difference created by the narrowed portion to reduce the outlet pressure thereof, preventing a decrease in efficiency of the evaporator.

16 Claims, 3 Drawing Sheets

WOBBLE PLATE TYPE COMPRESSOR WITH VARIABLE DISPLACEMENT MECHANISM

BACKGROUND OF THE INVENTION

1. Field of the Invention

The present invention relates to a refrigerant compressor, and more particularly, to a wobble plate type compressor with a variable displacement mechanism suitable for use in an automotive air conditioning system.

2. Description of the Prior Art

It has been recognized that it is desirable to provide a wobble plate type piston compressor with a displacement or capacity adjusting mechanism to control the compression ratio in response to demand. As disclosed in U.S. Pat. No. 4,428,718, the compression ratio may be controlled by changing the slant angle of the sloping surface of a slant plate in response to operation of a valve control mechanism. The slant angle of the slant plate is adjusted to maintain a constant suction pressure in response to a change in the heat load of the evaporator of an external circuit including the compressor or a change in rotation speed of the compressor.

In an air conditioning system, a pipe member connects the outlet of an evaporator to the suction chamber of the compressor. Accordingly, a pressure loss occurs between the suction chamber and the outlet of the evaporator which is directly proportional to the "suction flow rate" therebetween as shown in FIG. 5. As a result, as shown by the dash line in FIG. 4, when the capacity of the compressor is adjusted to maintain a constant suction chamber pressure in response to a change in the heat load of the evaporator or the rotation speed of the compressor, the pressure at the evaporator outlet increases as well. This increase in the evaporator outlet pressure results in an undesirable decrease in the heat exchanging ability of the evaporator.

U.S. Pat. No. 4,428,718 discloses a valve control mechanism to eliminate this problem. The valve control mechanism includes a device which senses the discharge pressure of the compressor and in response thereto, the valve element is shifted to maintain a constant pressure at the evaporator outlet portion. That is, the valve control mechanism makes use of the fact that the discharge pressure of the compressor is roughly directly proportional to the suction flow rate.

However, the relationship between the discharge pressure and the suction flow rate is not constant in every air conditioning system. Furthermore, the discharge pressure varies greatly in response to the velocity of air passing through the condensor. Accordingly, in an automotive air conditioning system in which the wind velocity varies greatly in response to the speed of the vehicle, the relationship is indefinite and unreliable. Therefore, the system is not sufficiently effective in preventing the undesirable increase in pressure at the evaporator outlet.

SUMMARY OF THE INVENTION

It is an object of this invention to provide a wobble plate type piston compressor with a capacity adjusting mechanism which compensates for the increase in pressure at the evaporator outlet when the capacity of the compressor is adjusted, to maintain a constant evaporator outlet pressure.

The refrigerant compressor in accordance with the present invention includes a compressor housing comprising a cylinder block with a front end plate and a rear end plate attached thereto. A crank chamber is defined between the front end plate and the cylinder block and a plurality of cylinders are formed in the cylinder block. A piston is slidably fitted within each of the cylinders and the pistons are reciprocated by a drive mechanism including a wobble plate, an adjustable slant plate with an inclined surface, a rotor and a drive shaft. The rotor is fixed to the drive shaft and the adjustable slant plate is connected to the rotor at an adjustable slant angle and is located in close proximity to the wobble plate. The drive shaft extends through the wobble plate and is rotatably supported within the front end plate and within a central bore in the cylinder block by bearings. Rotation of the rotor by the drive shaft causes the slant plate to rotate as well, causing the wobble plate to nutate, reciprocating the pistons in the cylinders.

The rear end plate includes a suction chamber and a discharge chamber defined therein. The suction chamber and the discharge chamber have inlet and outlet portions respectively which communicate with an external fluid circuit. A communication path links the crank chamber with the suction chamber and a valve control means controls the opening and closing of the communication path. The angle between the surface of the adjustable slant plate and the axis of the drive shaft can be changed in response to a change in pressure in the crank chamber which is controlled by the valve control means. Adjustment of the slant angle of the slant plate in turn changes the stroke length of the pistons and thus the capacity of the compressor.

The valve control means includes a valve element, a valve shifting element and a pressure difference producing means. The pressure difference producing means includes a narrowed region between an inlet portion of the suction chamber which is linked to an external evaporator and a main portion of the suction chamber. The valve shifting element includes a piston attached to the valve element. The valve element includes a bellows and a valve member. A pressure difference produced by the pressure difference producing means causes the valve shifting element to shift the operating point of the valve element, controlling the link of the crank chamber with the inlet portion of the suction chamber to maintain a constant pressure at the outlet of the evaporator when the suction flow rate changes.

Further objects, features and other aspects of the invention will be understood from the detailed description of the preferred embodiments of this invention with reference to the drawings.

DETAILED DESCRIPTION OF THE PREFERRED EMBODIMENTS

Figure 1:
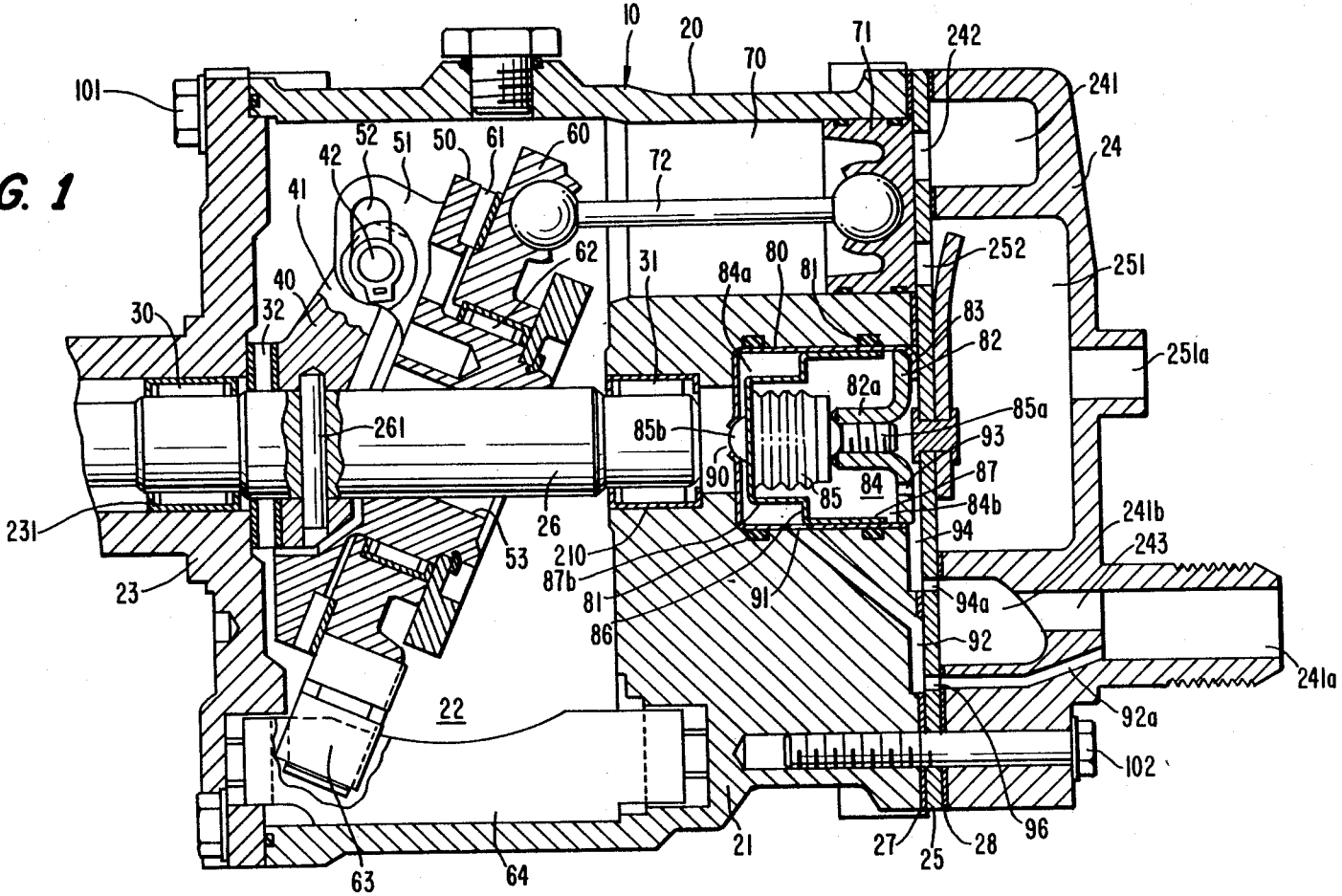
FIG. 1 is a vertical longitudinal sectional view of a wobble plate type refrigerant compressor in accordance with a first embodiment of this invention.

With reference to FIG. 1, wobble plate type refrigerant compressor 10 in accordance with one embodiment of the present invention is shown. Compressor 10 includes cylindrical housing assembly 20 including cylinder block 21, front end plate 23 at one end of cylinder block 21, crank chamber 22 formed between cylinder block 21 and front end plate 23, and rear end plate 24 attached to the other end of cylinder block 21. Front end plate 23 is mounted on cylinder block 21 forward (to the left in FIG. 1) of crank chamber 22 by a plurality of bolts 101. Rear end plate 24 is mounted on cylinder block 21 at its opposite end by a plurality of bolts 102. Valve plate 25 is located between rear end plate 24 and cylinder block 21. Opening 231 is centrally formed in front end plate 23 for supporting drive shaft 26 therethrough by bearing 30 disposed within. The inner end portion of drive shaft 26 is rotatably supported by bearing 31 disposed within central bore 210 of cylinder block 21. Bore 210 has an increased diameter portion rearward (to the right) of the end of drive shaft 26 containing the valve control mechanism as discussed below.

Cam rotor 40 is fixed on drive shaft 26 by pin member 261 and rotates therrewith. Thrust needle bearing 32 is disposed between the inner end surface of front end plate 23 and the adjacent axial end surface of cam rotor 40. Cam rotor 40 includes arm 41 having pin member 42 extending therefrom. Slant plate 50 is adjacent cam rotor 40 and includes opening through which passes drive shaft 26. Slant plate 50 includes arm 51 having slot 52. Cam rotor 40 and slant plate 50 are connected by pin member 42 which is inserted in slot 52 to create a hinged point. Pin member 42 is slidable within slot 52 to allow adjustment of the angular position of slant plate 50 with respect to the longitudinal axis of drive shaft 26.

Wobble plate 60 is rotatably mounted on slant plate 50 through bearings 61 and 62. Fork shaped slider 63 is attached to the outer peripheral end of wobble plate 60 and is slidably mounted on sliding rail 64 held between front end plate 23 and cylinder block 21. Fork shaped slider 63 prevents rotation of wobble plate 60 and wobble plate 60 nutates along rail 64 when cam rotor 40 rotates. Cylinder block 21 includes a plurality of peripherally located cylinder chambers 70 in which pistons 71 reciprocate. Each piston 71 is connected to wobble plate 60 by a corresponding connecting rod 72.

Rear end plate 24 includes peripherally located annular suction chamber 241 and centrally located discharge chamber 251. Valve plate 25 is located between cylinder block 21 and rear end plate 24 and includes a plurality of valved suction ports 242 linking suction chamber 241 with respective cylinders 70. Valve plate 25 also includes a plurality of valved discharge ports 252 linking discharge chamber 251 with respective cylinders 70. Suction ports 242 and discharge ports 252 are provided with suitable reed valves as described in U.S. Pat. No. 4,011,029 to Shimizu.

Suction chamber 241 includes inlet portion 241*a* which is connected to an evaporator of the external cooling circuit (not shown). Inlet portion 241*a* is linked to main portion 241*b* of suction chamber 241 via narrowed passage 243. Discharge chamber 251 is provided with outlet portion 251*a* connected to a condensor of the cooling circuit (not shown). Gaskets 27 and 28 are located between cylinder block 21 and the inner surface of valve plate 25, and outer surface of valve plate 25 and rear end plate 24 respectively, to seal the mating surfaces of cylinder block 21, valve plate 25 and rear end plate 24.

The valve control mechanism includes cup-shaped casing 80 disposed within central bore 210 rearward to the end of drive shaft 26. Cup-shaped casing 80 may be disposed in a region of central bore 210 with an extended diameter. At its open end, cup-shaped casing 80 is bent inward and is disposed adjacent to valve plate 25. A pair of O-ring seals 81 are disposed between an inner peripheral surface of central bore 210 and an outer peripheral surface of cup-shaped casing 80.

Seat member 82 is disposed on the inner surface of bent open end 83 of casing 80 to define chamber 84 between seat member 82 and cup-shaped casing 80. Seat member 82 includes annular projection 82*a* extending into chamber 84 and having a threaded interior. Gas charged bellows 85 has a predetermined internal pressure and is disposed within chamber 84. Screw member 85*a* is attached at the rear end of bellows 85 and is screwed into annular projection 82*a* to secure bellows 85 to seat member 82. Valve member 85*b* is located at the other end of bellows 85.

Generally cup-shaped piston member 86 is disposed within chamber 84 and valve member 85*b* extends through its closed bottom surface. Piston member 86 is attached to the valve element including both valve member 85*b* and bellows 85. Cup-shaped piston member 86 includes side wall 87 extending from its open end to a mid-point approximately half way there along. Side wall 87 is adjacent to an inner surface of cup-shaped casing 80 until its approximate midpoint and then bends inward to form reduced diameter portion 87*b*. Cup-shaped piston member 86 divides chamber 84 into front chamber 84*a* located between portion 87*b* and cup-shaped casing 80, and rear chamber 84*b* located between piston member 86 and seat member 82. A diaphragm may also be used in place of cup-shaped piston member 86.

Hole 90 is formed approximately at the center of the bottom of cup-shaped casing 80 and links crank chamber 22 with front chamber 84*a*. Valve member 85*b* fits within hole 90 to control this link. Hole 91 is formed in the lower side wall of cup-shaped casing 80 at a location adjacent front chamber 84*a* forward of piston member 86. Conduit 92 is formed within cylinder block 21 and links front chamber 84*a* with inlet portion 241*a* of suction chamber 241 via hole 91 in casing 80, hole 96 in valve plate 25, and corresponding conduit 92*a* formed in rear end plate 24. Hole 93 is formed in seat member 82 and links rear chamber 84*b* to main portion 241*b* of suction chamber 241 via conduit 94 formed between cylinder block 21 and valve plate 25, and hole 94*a* formed through valve plate 25.

During operation of compressor 10, drive shaft 26 is rotated by the engine of the vehicle through an electromagnetic clutch (not shown). Cam rotor 40 is rotated with drive shaft 26, rotating slant plate 50 as well which causes wobble plate 60 to nutate. Nutational motion of wobble plate 60 reciprocates pistons 71 in their respective cylinders 70. As pistons 71 are reciprocated, refrigerant gas which is introduced into main portion 241*b* of suction chamber 241 through inlet 241*a* and narrowed passage 243 is drawn into each cylinder 70 through suction ports 242 and then compressed. The compressed refrigerant gas is discharged to discharge chamber 251 from each cylinder 70 through discharge ports 252, and therefrom into the cooling circuit through outlet portion 251*a*.

The capacity of compressor 10 is adjusted to maintain a constant pressure in suction chamber 241 in response to a change in the heat load of the evaporator or a change in the rotating speed of the compressor. The capacity of the compressor is adjusted by changing the angle of the slant plate which is dependent upon the crank chamber pressure. An increase in crank chamber pressure decreases the slant angle of the slant plate and thus the wobble plate, decreasing the capacity of the compressor. A decrease in the crank chamber pressure increases the angle of the slant plate and the wobble plate and thus increases the capacity of the compressor.

Figure 3:
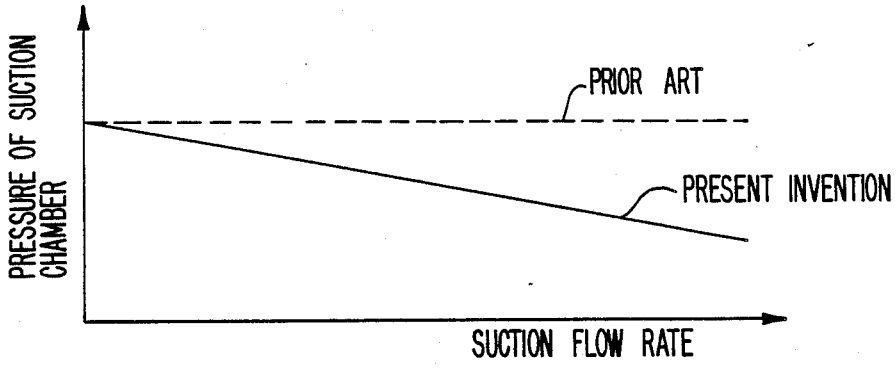
FIG. 3 is a graph showing the relation between the pressure of the suction chamber and the suction flow rate, wherein, the dash line represents the prior art and the solid line represents the present invention.
Figure 4:
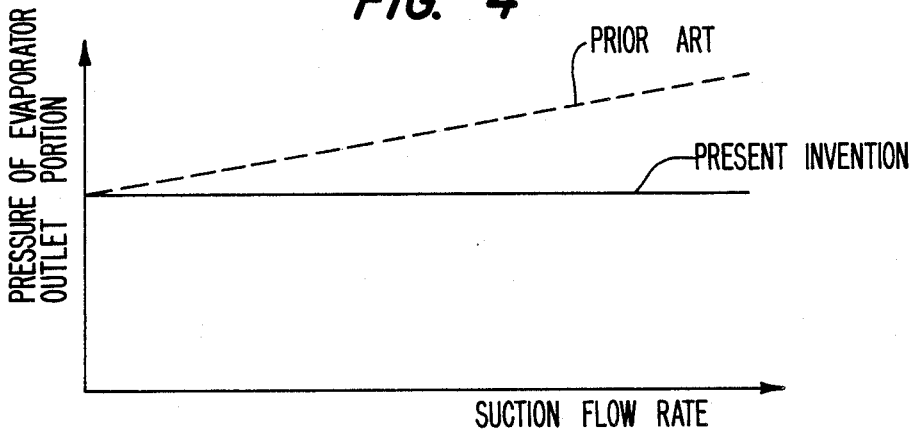
FIG. 4 is a graph showing the relation between the pressure at the outlet of an evaporator and the suction flow rate, wherein, the dash line shows the prior art and the solid line shows the present invention.
Figure 5:
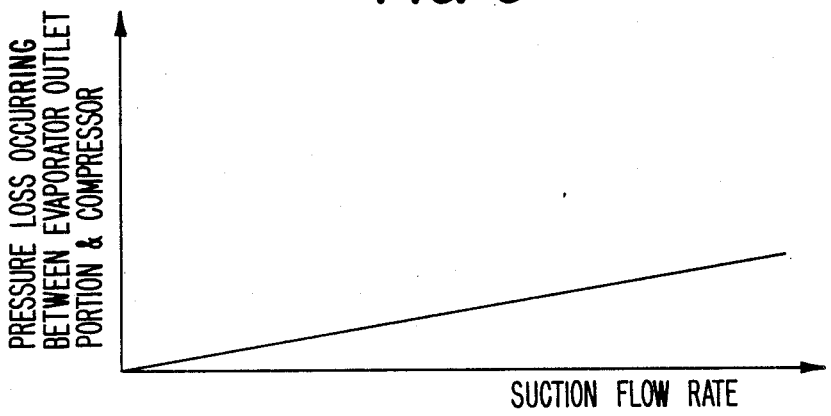
FIG. 5 is a graph showing the relation between the pressure loss occurring between the outlet of the evaporator and the compressor and the suction flow rate.

With references to FIGS. 3 and 4, the effect of the valve control mechanism of the present invention in maintaining a constant pressure at the outlet of the evaporator during capacity control of the compressor will be explained. When the refrigerant gas flowing from the evaporator flows from inlet portion 241*a* to main portion 241*b* of suction chamber 241 through narrowed passage 243, a pressure loss ($\Delta P$) occurs due to the effect of narrowed passage 243. Specifically, the pressure at inlet portion 241*a* is (P), and the pressure in main portion 241*b* is $P-\Delta P$). Accordingly, the pressure in front chamber 84*a* which is linked directly to inlet portion 241*a* through conduits 92 and 92*a* is greater than the pressure in rear chamber 84*b* which is linked to main portion 241*b* by conduit 94 by ($\Delta P$).

If the inner diameter of chamber 84 is represented by (D), a force (F) which is equal to $$\left(\Delta P\pi \frac{D^2}{4}\right)$$

acts on cup-shaped piston member 86 causing it to move towards the right in FIG. 1. As can be seen from this formula, the rightward force F is directly proportional to the pressure loss ($\Delta P$). Additionally, the pressure loss ($\Delta P$) is directly proportional to the suction flow rate. Thus the rightward acting force F acting on cup-shaped piston member 86 is dependent upon the suction flow rate, causing bellows 85 to contract moving valve member 85*b* to the right and out of hole 90 to link crank chamber 22 with inlet portion 241*a* to lower the pressure therein. The movement of valve member 85*b* is dependent on the suction flow rate and occurs when the rate increases. As a result, the increase in evaporator outlet pressure caused by an increase in suction flow rate is compensated by a decrease in pressure in inlet portion 241*a* due to the action of the valve control mechanism of the present invention. As shown in FIG. 4, the pressure at the evaporator outlet is maintained constant as the suction flow increases during a change in compressor capacity.

It should be noted that since bellows 85 is gas charged with a predetermined internal pressure, the decreased pressure ($P-\Delta P$) in chamber 84*b* tends to cause bellows 85 to expand and therfore create a leftward acting force on cup-shaped piston member 86. However, the force acting on cup-shaped piston member 86 due to the expansion pressure of bellows 85 is substantially less than the rightward force acting on cup-shaped piston member 86 due to the pressure difference ($\Delta P$), because the longitudinal pressure receiving area of cup-shaped piston member 86 which responds to the pressure difference extends throughout the diameter of cup-shaped housing 80 while the pressure provided due to expansion of bellows 85 acts only on an area smaller than reduced diameter area 87*b*. Therefore, the narrowed portion provides a net rightward acting force on bellows 85 through piston 86 tending to cause bellows 85 to contract. However, as is known in the prior art, gas charged bellows 85 would act in response to the pressure within chamber 84*b* to move valve member 85*b* into or out of hole 90 to control the link between the crank and suction chambers, even if cup-shaped piston member 86 was not present. Thus, cup-shaped piston member 86 acts on bellows 85 so as to shift the control or acting pressure point at which bellows 85 contracts to open the link between the crank and suction chambers. As the suction flow rate increases, the pressure difference increases thereby increasing the net rightward acting force of piston member 86 on bellows 85. Therefore, the pressure at which bellow 85 contracts to link the crank chamber and the suction inlet decreases with increasing suction flow rate, to lower the suction inlet pressure and maintain the evaporator outlet pressure constant.

Figure 2:
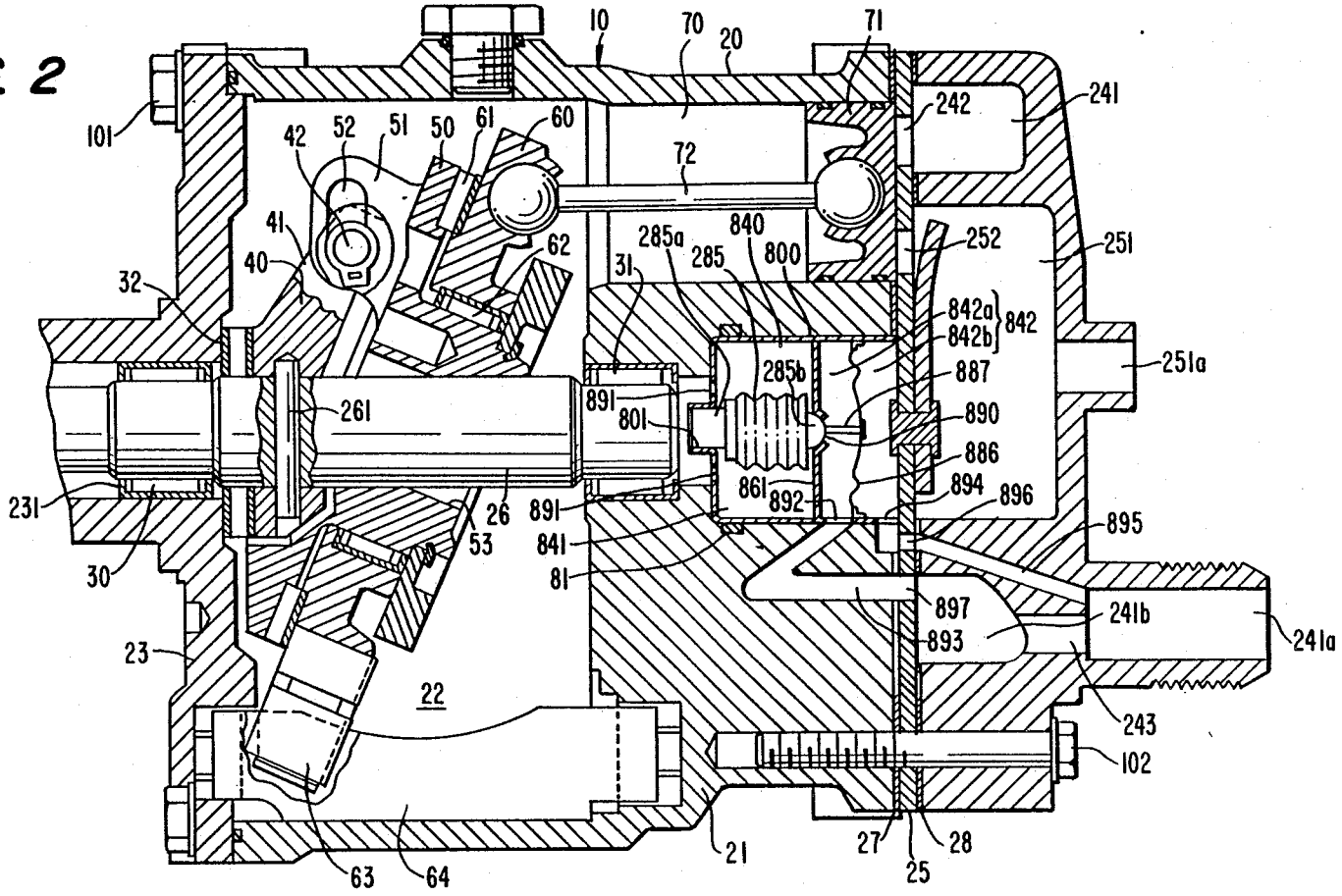
FIG. 2 is a vertical longitudinal sectional view of a wobble plate type refrigerant compressor in accordance with a second embodiment of this invention.

FIG. 2 shows a second embodiment of the present invention in which the same numerals are used to denote the same elements shown in FIG. 1. In the second embodiment, the valve control mechanism includes bellows 285 which longitudinally contracts or expands in response to the pressure of crank chamber 22. Bellows 285 is disposed within chamber 840 defined between cup-shaped casing 800 and valve plate 25. Wall 861 extends within cup-shaped casing 800 and divides chamber 840 into first chamber 841 on the forward side and second chamber 842 on the rearward side as shown in FIG. 2. Wall 861 includes hole 890 centrally located therethrough. Screw member 285*a* is attached at the forward side of bellows 285 and is screwed into threaded portion 801 formed at the center of the bottom end of cup-shaped casing 800. Valve member 285*b* is attached at the opposite end of bellows 285 and fits within hole 890.

Diaphragm 886 having pin 887 disposed thereon is located within second chamber 842 and further divides second chamber 842 into front second chamber 842*a* and rear second chamber 842*b*. Pin 887 projects from diaphragm 886 and is disposed adjacent valve member 285*b* through hole 890. A pair of holes 891 is formed at the bottom end (left side) of cup-shaped casing 800 to link crank chamber 22 with first chamber 841 through a gap in bearing 31 supporting drive shaft 26.

Hole 892 is formed in the side wall of cup-shaped casing 800 adjacent front second chamber 842, that is, to the right of wall 861. Hole 894 is formed in the side wall of cup-shaped housing 800 at a location adjacent rear second chamber 842*b*, that is, to the right of disphragm 886. Conduit 893 is formed in cylinder block 21 and links front second chamber 842*a* to main portion 241*b* via hole 892 and hole 897 in rear end plate 24. Conduit 895 is formed in rear end plate 24 and links inlet portion 241*a* and rear second chamber 842*b* through hole 894 in cup-shaped housing 800 and hole 896 in rear end plate 24.

As in the first embodiment, a pressure difference is created between inlet portion 241*a* and main portion 241*b* of suction chamber 241 by narrowed region 243.

However, this pressure difference creates a leftward force on diaphragm 886 which moves pin 887 to the left, forcing valve element 285*b* out of hole 890 and thereby linking crank chamber 22 to the evaporator. The operation of the valve control mechanism of this embodiment is substantially similar to that in the first embodiment and a further explanation of this operation is omitted.

This invention has been described in detail in connection with the preferred embodiments. These embodiments, however, are merely for example only and the invention is not restricted thereto. It will be understood by those skilled in the art that other variations and modifications can easily be made within the scope of this invention as defined by the claims.

I claim:

1. In a refrigerant compressor including a compressor housing having a cylinder block provided with a plurality of cylinders, a front end plate disposed on one end of said cylinder block and enclosing a crank chamber within said cylinder block, a piston slidably fitted within each of said cylinders and reciprocated by a drive mechanism including a drive shaft, a rotor connected to said drive shaft, an adjustable slant plate having an inclined surface adjustably connected to said rotor and having an adjustable slant angle with respect to the longitudinal axis of said drive shaft, said slant angle changing in response to a change in pressure in said crank chamber to change the capacity of said compressor, and linking means operationally linking said drive mechanism to said pistons such that rotational motion of said drive shaft, said rotor and said slant plate reciprocates said pistons in said cylinders, a rear end plate disposed on the opposite end of said cylinder block from said front end plate and defining a suction chamber and a discharge chamber therein, said suction and discharge chambers having inlet and outlet portions respectively linked to an external fluid circuit, a communication path linking said crank chamber with said suction chamber, and a communication control means for controlling the link of said crank chamber with said suction chamber through said communication path, the improvement comprising;

said communication control means including a valve control means responsive to the pressure of said suction chamber for controlling the opening and closing of said communication path, a valve control point shifting means for shifting the suction chamber pressure control point at which said valve control means responds, said valve control point shifting means acting in response to a pressure difference between a first pressure on one side thereof and a second pressure on a second side thereof, and a pressure difference producing means for producing said pressure difference in dependence upon the suction flow rate of refrigerant fluid into said compressor.

2. The refrigerant compressor of claim 1 wherein said valve control means includes a bellows and a valve member, said bellows longitudinally contracting or expanding in response to the pressure of said suction chamber to control the link between said communication path and said crank chamber.

3. The refrigerant compressor recited in claim 1, said linking means comprising a wobble plate disposed about said drive shaft, said inclined surface of said slant plate in close proximity to said wobble plate, said wobble plate linked to said pistons, rotational motion of said slant plate converted into nutational motion of said wobble plate to reciprocate said pistons in said cylinders.

4. The refrigerant compressor of claim 1 wherein said valve control paint shifting means is a cup-shaped piston member.

5. The refrigerant compressor of claim 1, said suction chamber further comprising an inlet portion and a main portion, said pressure difference producing means comprising a narrowed passage formed between said inlet portion and said main portion, said narrowed passage causing the pressure in said main portion to be less than the pressure in said inlet portion, the pressure difference increasing with increasing suction flow rate, said one side of said valve control point shifting means linked to said main portion and said second side linked to said inlet portion.

6. The refrigerant compressor of claim 5, said valve control means responsive to the pressure in said main portion of said suction chamber, said valve control point shifting means acting at increasing suction flow rate to decrease the main portion pressure at which said valve control means responds to open said communication path.

7. The refrigerant compressor of claim 6, said cylinder block including a central bore disposed therein, said valve control point shifting means comprising a cup-shaped piston member slidably disposed in said bore and dividing said bore into a forward chamber on said second side and a rear chamber on said first side, said valve control means disposed in said rear chamber, said forward chamber linked to said crank chamber such that said link is controlled by said valve control means, said communication path including said forward chamber and a conduit linking said forward chamber to said suction inlet portion.

8. The refrigerant compressor of claim 7 further comprising a casing disposed in said central bore and having a hole therethrough, said forward chamber disposed between said casing and said piston and linked to said crank chamber by a hole through said casing.

9. The refrigerant compressor of claim 8, said valve control means comprising a bellows disposed in said rear chamber and having a valve member disposed thereon, said piston disposed on said bellows such that said valve member extends therethrough, said bellows expanding or contracting in response to the pressure in said main portion such that said valve member closes or opens said hole to control the link of said crank chamber to said forward chamber.

10. In a refrigerant compressor including a compressor housing having a cylinder block provided with a plurality of cylinders, a front end plate disposed on one end of said cylinder block and enclosing a crank chamber within said cylinder block, a piston slidably fitted within each of said cylinders and reciprocated by a drive mechanism including a drive shaft, a rotor connected to said drive shaft, an adjustable slant plate having an inclined surface adjustably connected to said rotor so as to have an adjustable slant angle with respect to the longitudinal axis of said drive shaft, said slant angle changing in response to a change in pressure in said crank chamber to change the capacity of said compressor, and linking means operationally linking said drive mechanism to said pistons such that rotational motion of said drive shaft, said rotor and said slant plate reciprocates said pistons in said cylinders, a rear end plate disposed on the opposite end of said cylinder block from said front end plate and defining a suction chamber and a discharge chamber therein, said suction and discharge chambers having inlet and outlet portions respectively linked to an external fluid circuit, a communication path linking said crank chamber with said suction chamber, and a communication control means for controlling the link of said crank chamber and said suction chamber through said communication path, the improvement comprising;

said communication control means including a valve control means responsive to the pressure in said crank chamber for controlling the opening and closing of said communication path, a valve control point shifting means for shifting the crank chamber pressure control point at which said valve control means responds, said valve control point shifting means acting in response to a pressure difference between a first pressure on one side thereof and a second pressure on a second side thereof, and a pressure difference producing means for producing said pressure difference in dependence upon the suction flow rate of refrigerant fluid into said compressor.

11. The refrigerant compressor of claim 10 wherein said valve control paint shifting means is a diaphragm.

12. The refrigerant compressor recited in claim 10, said linking means comprising a wobble plate disposed about said drive shaft, said inclined surface of said slant plate in close proximity to said wobble plate, said wobble plate linked to said pistons, rotational motion of said slant plate converted into nutational motion of said wobble plate to reciprocate said pistons in said cylinders.

13. The refrigerant compressor of claim 10, said suction chamber further comprising an inlet portion and a main portion, said pressure difference producing means comprising a narrowed passage formed between said inlet portion and said main portion, said narrowed passage causing the pressure in said main portion to be less than the pressure in said inlet portion, the pressure difference increasing with increasing suction flow rate, said one side of said valve control point shifting means linked to said main portion and said second side linked to said inlet portion.

14. The refrigerant compressor of claim 13, said cylinder block including a central bore disposed therethrough, a dividing means for dividnig said central bore into a forward chamber and a rear chamber, said valve control point shifting means comprising a diaphragm disposed in said rear chamber and extending completely across said rear chamber to divide said rear chamber into a first chamber on said first side and a second chamber on a said second side such that said first chamber is linked to said main portion and said second chamber is linked to said inlet portion, said diaphragm acting in response to the increasing pressure difference at increasing suction flow rate to decrease the crank chamber pressure at which said valve control means responds to open said communication path.

15. The refrigerant compressor of claim 14, said forward chamber continually linked to said crank chamber at one side and controllably linked to said first chamber at a second side, said valve control means disposed in said forward chamber and responsive to the crank chamber pressure for controlling the link of said forward chamber to said first chamber.

16. The refrigerant compressor of claim 15, said communication path comprising said forward chamber, said first chamber and a conduit linking said first chamber to said main portion of said suction chamber, said dividing means comprising a hole therethrough linking said forward chamber and said first chamber, said valve control means comprising a bellows disposed in said forward chamber and having a valve member thereon for controlling the opening of said hole responsive to the crank chamber pressure, said valve control point shifting means further comprising a pin extending from said diaphragm to about the location of said hole, said pin adjustably contacting said valve member in response to said pressure difference on said diaphragm to lower the pressure of said crank chamber at which said bellows contracts to link said forward chamber and said first chamber.

* * * * *

UNITED STATES PATENT AND TRADEMARK OFFICE

CERTIFICATE OF CORRECTION

PATENT NO. : 4,913,626

DATED : April 3, 1990

INVENTOR(S) : Kiyoshi Terauchi

It is certified that error appears in the above-identified patent and that said Letters Patent is hereby corrected as shown below:

Column 3, line 35 after "opening" insert -- 53--.

Column 9, line 24, "paint" should be --point--.

Signed and Sealed this

Thirteenth Day of August, 1991

*Attest:*

HARRY F. MANBECK, JR.

*Attesting Officer*

*Commissioner of Patents and Trademarks*